US005484143A

United States Patent [19]

Hirose et al.

[11] Patent Number: 5,484,143

[45] Date of Patent: Jan. 16, 1996

[54] SHEET SORTING AND STORING APPARATUS

[75] Inventors: Akira Hirose, Tokyo; Takashi Fujii, Omiya; Yoshihide Sugiyama, Nagoya; Kunihiro Uotani, Nagoya; Fumitaka Hyoudou, Nagoya, all of Japan

[73] Assignee: Ricoh Company Ltd., Tokyo, Japan

[21] Appl. No.: 216,403

[22] Filed: Mar. 23, 1994

Related U.S. Application Data

[63] Continuation-in-part of Ser. No. 848,181, Mar. 10, 1992, abandoned.

[30] Foreign Application Priority Data

| | | | |
|---|---|---|---|
| Mar. 12, 1991 | [JP] | Japan | 3-70428 |
| May 1, 1991 | [JP] | Japan | 3-126475 |
| Jun. 3, 1991 | [JP] | Japan | 3-157451 |
| Sep. 30, 1991 | [JP] | Japan | 3-276417 |
| Dec. 20, 1991 | [JP] | Japan | 3-354324 |
| Mar. 30, 1993 | [JP] | Japan | 5-072169 |
| Feb. 23, 1994 | [JP] | Japan | 6-025452 |

[51] Int. Cl.[6] ..... B65H 39/10

[52] U.S. Cl. ..... 271/293; 271/294; 271/220

[58] Field of Search ..... 271/293, 294, 271/292, 220

[56] References Cited

U.S. PATENT DOCUMENTS

| | | | |
|---|---|---|---|
| 4,068,837 | 1/1978 | Lamos | 271/220 X |
| 5,048,820 | 9/1991 | Chung et al. | 271/293 |
| 5,112,035 | 5/1992 | Yamamoto et al. | 271/293 X |
| 5,253,860 | 10/1993 | Hirose et al. | 271/293 X |

FOREIGN PATENT DOCUMENTS

| | | | |
|---|---|---|---|
| 4207765 | 9/1992 | Germany | 271/293 |
| 5-8925 | 1/1993 | Japan . | |
| 2224010 | 4/1990 | United Kingdom | 271/220 |
| 2253617 | 9/1992 | United Kingdom | 271/293 |

*Primary Examiner*—David H. Bollinger
*Attorney, Agent, or Firm*—Oblon, Spivak, McClelland, Maier, & Neustadt

[57] ABSTRACT

A sheet sorting and storing apparatus has a stack of bin trays which are brought open at a sheet reception position, but held close at the other position. The apparatus minimizes noises upon sheet reception with a simple mechanism, improving the efficiency of sheet sorting. The bin trays are inclined down or up depending on a position of a sheet discharge device. A desired bin tray is deviated by a deviation mechanism in an approximately horizontal direction so that a spacing in the direction of the tray inclination is enlarged between two adjacent bin trays located at the sheet reception position, while keeping constant a vertical spacing thereof. A flexible film of elastic material may be provided at the sheet entrance side of the bin trays to prevent the discharged sheet from leaping out thereof.

14 Claims, 10 Drawing Sheets

SHEET SORTING AND STORING APPARATUS

The present application is a continuation-in-part of U.S. patent application No. 07/848,181, filed on Mar. 10, 1992, now abandoned.

BACKGROUND OF THE INVENTION

1. Field of the Invention

The present invention relates to a sheet sorting and storing apparatus. More particularly, the present invention relates to a sheet sorting and storing apparatus having a plurality of bin trays for consecutive reception of sheets discharged from an external apparatus like an image forming apparatus such as a copier.

2. Description of the Related Art

In some conventional sheet sorting and storing apparatus, a spacing between bin trays is enlarged upon sheet discharge to facilitate sheet storage. For example, Japanese Unexamined Patent Publication Sho 57-4855 discloses a sheet jogger/sorter using a Geneva wheel to open a spacing between a determined bin tray and the next upper bin tray to readily receive a discharged sheet thereon. Further, Japanese Unexamined Patent Publication Sho 5678769 discloses an improved sorter using a helical cam to similarly open a spacing between bin trays.

Another type of conventional sorter is one which does not open spacing between bin trays to facilitate the sheet reception. For example, Japanese Unexamined Patent Publication Hei 2110075 discloses a sorting apparatus using a cam in connection with vertical motion of parallel bin trays to move a desired bin tray for receiving a discharged sheet so as to form a sheet reception entrance without opening the spacing between the bin trays.

In the apparatus of the former type which opens the bin tray spacing upon sheet reception, a room for sheet storage may be saved because the bin trays are held at a normally unenlarged bin tray spacing except the sheet receiving bin tray. It is, however, required that a mechanical structure using a Geneva wheel or a helical cam be used in the mechanism for the space opening, which is disadvantageous with respect to a smooth space opening operation. Also, offensive shock noises cannot be avoided in such a mechanism upon the spacing opening operation.

In the latter device, the spacing between the bin trays is always kept constant, so that a space opening mechanism is unnecessary and noises may be reduced. It is, however, difficult for such a mechanism to produce a sufficient sheet receiving entrance size, causing a problem of sorting or receiving a sheet when bent or curved. Furthermore, if a substantial number of sheets are expected to be stored on the bin trays, all the spacings between the bin trays must be enlarged, which results in increase in scale of the apparatus. This increase in size of the apparatus is contrary to the desire of downsizing. Therefore, the latter mechanism includes an inherent disadvantage to realize both downsizing and sufficient storage amount of sheets.

SUMMARY OF THE INVENTION

An object of the present invention is to provide a sheet sorting and storing apparatus, minimizing offensive shock noises and sheet leaping-out from the bin trays upon sheet reception, which is simple in mechanism and effective to receive a bent or curved sheet, in-which a spacing between bin trays is kept narrow enough to store a desired amount of sheets at a normal position where the sheet receiving operation is not effected, while the spacing between bin trays is opened relatively larger upon the sheet receiving operation to facilitate the sheet storing operation.

The object of the invention can be achieved by a sheet sorting and storing apparatus having a plurality of vertically stacked bin trays each loading face of which is inclined in a direction of sheet discharge out of an external device so as to receive a discharged sheet therefrom, comprising:

supporting means for supporting each of said bin trays movably in a substantially horizontal direction;

deviating means being adapted to deviate partially said stacked bin trays with respect to said substantially horizontal direction in such a manner that an upper space of a desired one bin tray to receive said discharged sheet is enlarged, said upper space being defined as a distance between said loading face of said desired one bin tray and a bottom face of an upwardly adjacent bin tray to said desired one bin tray with respect to a direction perpendicular to said inclined direction; and sheet press means extending upwardly on said introducing side of each of said bin trays, a tip of said sheet press means standing upright at a position on which said upper space is enlarged and lying towards said loading face at the other position.

In this arrangement, when the vertically moving mechanism reaches the sheet reception position, the deviation mechanism approximately horizontally deviates the bin tray at the sheet reception to enlarge a spacing between the two bin trays at and above the sheet discharge position to enable the sheet reception on the desired bin tray. The sheet press member contacts with the back of the next upper bin tray and therefore is pressed towards the loading face of the bin tray. The tip of the sheet press member is bent to lie there at the normal position above and below the sheet receiving position. By this, the bending of the sheet may be corrected, so that the sheet is loaded on the bin tray in a flat condition. In the sheet receiving position, the tip of the sheet press member stands upright to prevent the sheet on the bin tray from leaping out thereof.

According to this arrangement, the spacing is enlarged between the bin trays in a smooth manner, and the offensive shock noises may be avoided upon the enlarging operation of bin tray spacing. Also, the sheet press member effectively prevents the sheet leap-out upon reception and corrects the bending of the sheet on the loading face of the tray. Since the bin tray spacing may be minimized, the efficiency of sheet storage is high in this arrangement.

The sheet press member may be a flexible film of elastic material. Such sheet press member is effective and cheap in production in a simple form.

A further object of the present invention is to provide a sheet sorting and storing apparatus, in which said sheet press means has not lost its flexibility and keeps standing uprightly for long time and in which the sheet on the tray cannot be transferred backward over the sheet press means.

This object of the invention can be achieved by said sheet press means further comprising, a movable fence vertically extending at and pivotally being connected to an end fence of the bin tray at the sheet entrance side, a flexible film extending from said movable fence, and driving means for forcing the movable fence to stand uprightly.

The driving means may be a spring. Such driving means is effective and cheap in production in a simple form.

The movable fence may be connected to the end fence of the bin tray through the flexible film as a pivot. Such structure is effective and cheap in a simple form because any additional pivot means is not necessary in the device.

The bin tray may have a recess formed on the bottom of said bin tray where the movable fence is stored when a space of the bin trays is narrow. According to this structure, a space between the bin trays can be made narrower.

The bin tray may have a projection formed on the bottom of said bin tray. Such a projection helps to guide the sheet which is transferred to the bin tray.

The movable fence has tongues on the top portion whose distance is longer than the maximum length of a sheet width. Such tongues guard the flexible film from the upper bin tray when the bin tray spacing is minimized.

Further objects and advantages of the present invention will be apparent from the following description of the preferred embodiments of the invention as illustrated in the accompanying drawings.

BRIEF DESCRIPTION OF THE DRAWINGS

FIG. 11 (*b*) is an enlarged detail of a part in FIG. 11 (*a*); and

DESCRIPTION OF THE PREFERRED EMBODIMENTS

Preferred embodiments of the present invention are below described in detail with reference to the drawings.

Figure 1:
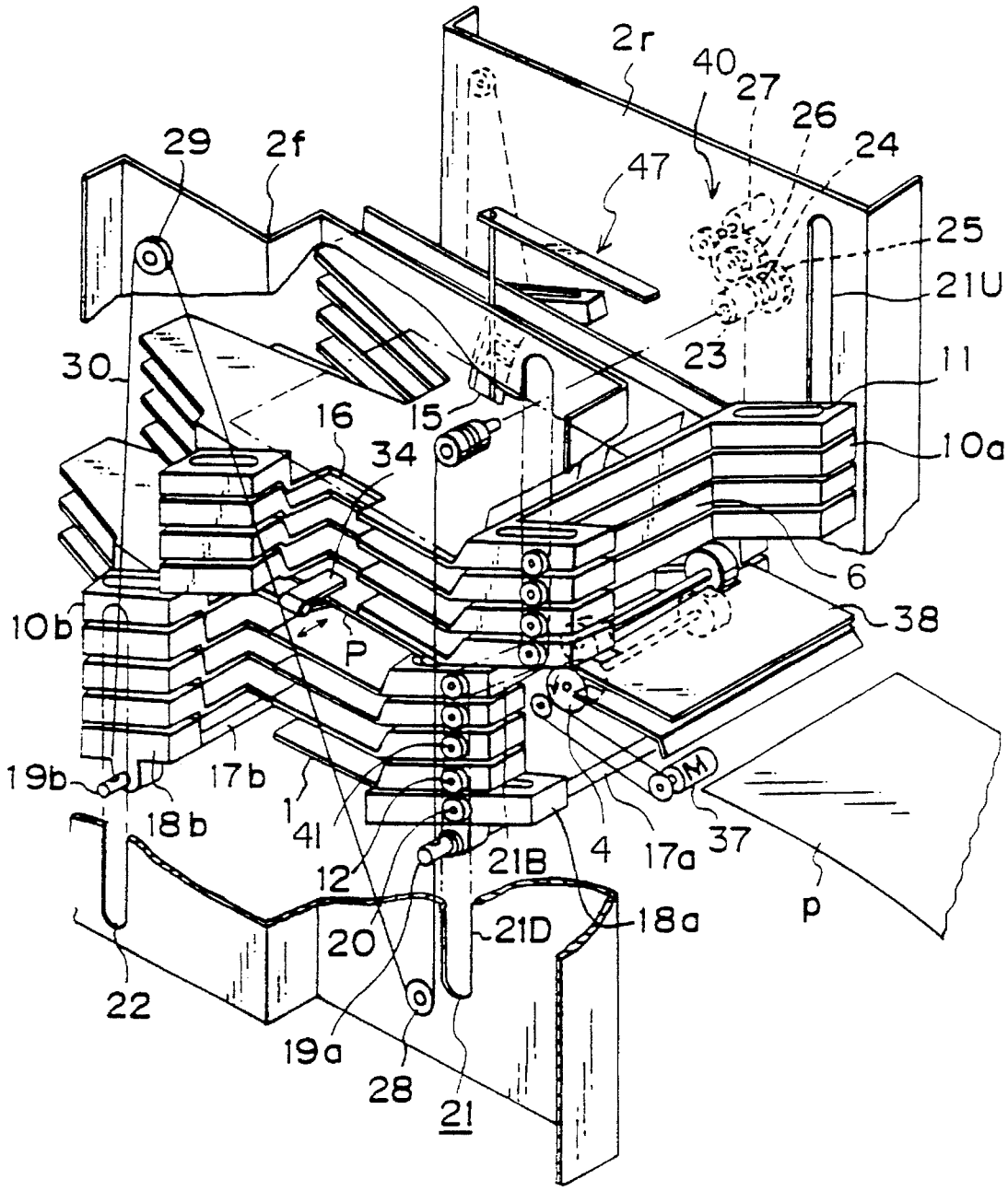
FIG. 1 is a perspective view of the first embodiment of a sheet sorting and storing apparatus according to the present invention.
Figure 2:
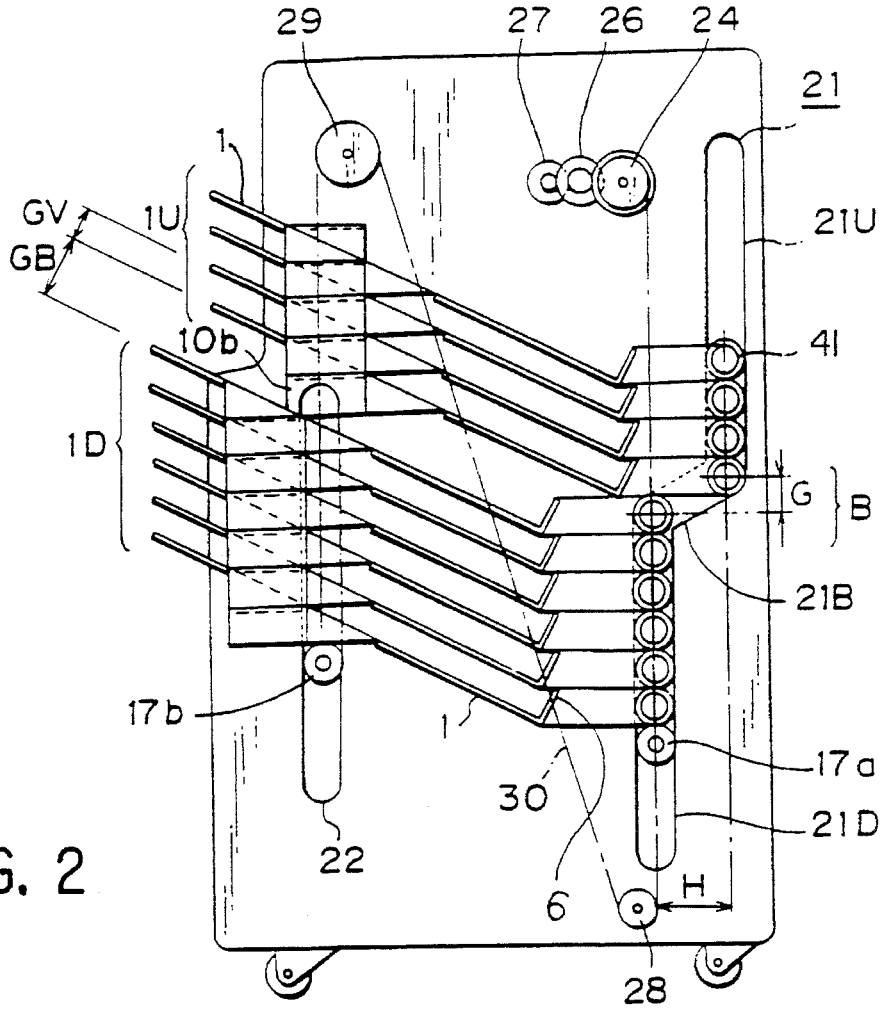
FIG. 2 is a drawing to illustrate deviation of bin trays in the sheet sorting and storing apparatus of FIG. 1.

FIG. 1 is a perspective view of the first embodiment of the entire sheet sorting and storing apparatus according to the present invention. FIG. 2 is a side view of bin trays to illustrate deviation of bin trays in the apparatus. The sheet sorting and storing apparatus of the preferred embodiment is an after-processing apparatus which sorts the image recorded sheets discharged from an image forming apparatus such as a copier and staples them to provide a plurality of sets of copied sheets in succession. The sheet sorting and storing apparatus is usually used in close connection with an adjacent image forming apparatus.

The structure of the sheet sorting and storing apparatus will be explained below with reference to FIGS. 1 and 2.

Reference numeral 1 denotes bin trays with sheet loading faces inclined down to the sheet receiving entrance thereof to receive image transferred sheets p carried from the right in the drawings. Numeral 10*a*, 10*b* represent slide cams to hold the bin trays 1 in a stack with each cam having the upper and the lower surfaces in a horizontal condition. A pair of slide cams 10*a* are disposed at the both sides of a bin tray at the sheet entrance side of the apparatus, and another pair of slide cams 10*b* are at the both sides of the bin tray near the free end thereof. The multiple bin trays 1 are vertically stacked, and are vertically movable together in the stack condition by means of a vertically moving device. Upon the vertical movement, the respective bin trays 1 move either into the upper stack 1U or into the lower stack 1D by moving a determined distance in the sheet carry direction one by one by a horizontal slide mechanism including later-described cam tracks.

A sheet stapler and a sheet move unit (not shown) are fixedly mounted near this end of the bin tray 1 located at the lowermost position of the upper stack 1U.

In the bin tray 1, numeral 11 denotes a lower groove of approximately semi-cylindrical shape extending along the both upper and lower surfaces of the slide cam 10. Numeral 41 represents trunnions fit to rotate on pins 12 projecting out of the both sides of the slide cams 10*a*. Numeral 6 represents a rear end aligning fence formed at a sheet receiving side of the bin tray 1 to align the rear ends of the loaded sheets. Numeral 15 represents an opening through which a jogger wire of later-explained jogger 47 and numeral 16 represents a cut in which the pinch mechanism of the sheet move unit is located. Rollers which are not shown in the figures are fit in the roller grooves 11 between the slide cams 10 of two adjacent bin trays 1.

Next described are a lifting device 40 for vertical movement of bin tray 1 and a horizontal slide mechanism of the bin trays 1. The horizontal slide mechanism moves a bin tray 1 along the slide cams 10, using the vertical driving force of the lifting device 40.

Numerals 2*f*, 2*r* are front and rear frames. The front and rear frames 2*f*, 2*r* have elongated cam tracks 21 near the sheet entrance and vertically elongate guide slots 22 near the free end of the bin tray. Each of the cam tacks 21 is composed of a upper vertical part 21U, a lower vertical part 21D, and a deviation part 21B connecting therebetween. The deviation part 21B is a slant portion gradually inclined down from the sheet receiving side, connecting the upper and the lower vertical parts 21U, 21D. The trunnions 41 of the bin trays 1 and trunnions of a support member of the first bin drive bar as described later are fit in the cam tracks 21 to be guided therealong.

A rotation shaft 23 is supported through bearings above the lower vertical parts 21D of the cam tracks 21. Wind-up pulleys 24 are fixed on the both ends of the rotation shaft 23 outside the front and rear frames 2*f*, 2*r*. A wind-up gear 25 fits on the rotation shaft 23 outside the wind-up pulley 24 at that side. The wind-up gear 25 is in mesh with a reduction gear 26, constituting a group of meshing gears. A lifting motor 27 is mounted outside the rear frame 2*r* as a power source for the lifting device 3. The drive force of the lifting motor 27 is transmitted to the wind-up gear 25 through the meshing gears. First and second direction change pulleys 28, 29 are journaled below the lower vertical parts 21*d* of the cam tracks 21 and above the guide slots 22, respectively, outside the front and rear frames 2*f*, 2*r*.

Numerals 17*a*, 17*b* represent first and second bin drive bars, and 30 represents suspension wires. One end of each suspension wire 30 is wound around the wind-up pulley 24. The suspension wires pass through the first and the second direction change pulleys 28, 29, and are then secured at the both ends 19*b* of the second bin drive bar 17*b*. Further, the suspension wires 30 are also secured to the both ends 19*a* of the first bin drive bar 17*a* between the wind-up pulley 24 and the first direction change pulley 28. The suspension wires 30 suspend the stack of bin trays 1 through the first and the second drive bars 17*a*, 17*b* so as to be vertically movable.

First and second support members 18*a*, 18*b* are fixed to the both ends of the first and the second drive bars 17*a*, 17*b* to carry the bin trays 1. The first and second support members 18*a*, 18*b* also have roller grooves 11 on their upper surfaces extending right to left in FIG. 1 and FIG. 2. The support members 18*a*, 18*b* support the bin trays 1 through rollers (not shown) fit in the roller grooves 11. The first support member 18*a* has pins 20 projecting out on which the trunnions 41 are rotatably mounted. The trunnions 41 of the first support member 18*a* are also fit in the cam tracks 21 as the trunnions 11 of the bin trays 1, moving together upon the vertical movement along the cam tracks 21.

Numeral 4 denotes a pair of sheet discharge rollers in an image processing apparatus set before the sheet sorting and storing apparatus, and 38 represents upper and lower sheet carry guide plates to guide a transfer sheet p discharged from the image processing apparatus, located just before the sheet discharge roller pair 4. The pair of sheet discharge rollers 4 are located at the sheet entrance side of the bin tray 1 in a deviation region B. The rollers 4 are driven by a sheet discharge motor 37 to discharge an image-formed transfer sheet p through the sheet carry guide plate 38 onto the appointed bin tray 1.

Below described is an operation of the apparatus of the present embodiment.

When a print start button is pressed on an unrepresented image forming apparatus, an image is recorded on a transfer sheet p. The image recorded transfer sheet p is transmitted to the sheet sorting and storing apparatus through the pair of sheet discharge rollers 36. Also, a signal is transmitted from the image forming apparatus to the sheet sorting and storing apparatus to select a determined bin tray 1. After the sheet sorting and storing apparatus receives the signal, the lifting motor 27 rotates by a determined number of rotations clockwise or counterclockwise so as to locate the determined bin tray 1 in the deviation region B, vertically moving the bin trays 1 by the suspension wire 30. The bin trays 1 vertically move up and down by the guide of trunnions 41 mounted on the slide cams 10a along the cam tracks 21.

Suppose a bin tray 1 is in the lower stack 1D. The suspension wires 30 lift up the bin trays 1 carried by the first and second support members 18*a*, 18*b* of the first and the second bin drive bars 17*a*, 17*b*, by a necessary distance. When the bin tray 1 reaches the deviation part 21 B of the cam tacks 21 as guided by the rotations of the trunnions 41, the vertical ascending of the bin tray 1 is stopped by the deviation parts 21B inclined towards the sheet receiving side. Then the trunnions 41 move along the slant of the deviation part 21B towards the sheet receiving side. The bin tray 1 horizontally slides in response to the above movement of the trunnions 41 towards the sheet receiving side with the support of the rollers (not shown) rolling in the roller grooves 11. When the trunnions 41 of the bin tray 1 reach the right upper end of the deviation parts 21B, they are again guided vertically upwards along the upper vertical parts 21U of the cam tracks 21.

By this operation, the trunnions 41 of the bin trays 1 move one by one from the lower vertical part 21D to the upper vertical part 21U, while horizontally moving the bin trays 1 in the deviation region B. Meanwhile, the determined bin tray 1 reaches the deviation region B and the lifting motor 27 stops rotating, so that the determined bin tray 1 may be ready to receive the image transfer sheet thereon. After this operation, the free ends of the upper stack of bin trays 1 located above with respect to the deviation region B are displaced by a horizontal distance H from the free ends of the lower stack of bin trays 1 located below the deviation region B. Therefore, it is easy for one to observe the state of the loading face of the bin tray 1 ready to receive the transfer sheet p in the deviation region B. This is advantageous because one can readily check the image formed condition or the stack condition on the transfer sheet P. In this embodiment, the space enlarging operation between the bin trays 1 in the deviation region B is achieved only by the horizontal displacement of the bin trays 1 caused by the guide of trunnions 13 through the cam tracks 21 in connection with the vertical movement of the bin trays 1. A vertical relation between the bin trays 1 remains unchanged after the deviation. In other words, the vertical spacing G is always maintained constant between the bin trays 1, whereby the slide cams 10 are never separated from each other, serving as support between the bin trays. As seen in FIG. 2, due to the horizontal movement of distance H of the bin tray 1 from the lower stack 1D to the lower stack 1U, a spacing GB in the deviation region B is enlarged in correspondence with the vertical movement distance of the bin tray 1 and the slant of the deviation part 21B of the cam track 21, as compared with a spacing GV between the bin trays in the upper stack 1U and in the lower stack 1D.

As described above, the paired sheet discharge rollers 4 are mounted to face the sheet receiving ends of the bin trays 1 in the deviation region B, and the transfer sheet p is discharged through the enlarged spacing GB of the bin trays 1. The sheet discharged from the rollers 36 leans against the rear end aligning fence 6 because of its own weight, aligning its rear end. Although the spacing GB of the bin trays 1 may be more enlarged if the slant angle of the deviation part 21B is smaller, the smaller slant angle would cause a difficulty of movement of trunnions 41 between the lower and the upper vertical part 21D, 21U. On the contrary, if the slant angle of the deviation part 21B is too large, the spacing GB of bin trays 1 in the deviation region B would not be sufficient. Therefore, the slant angle should be determined considering both conditions. After the rear ends of the transfer sheet are aligned, the jogger starts its operation.

If another signal is transmitted to the sheet sorting and storing apparatus to assign the next bin tray in response to the next sheet discharge of transfer sheet p from the image forming apparatus, the lifting motor 27 rotates the necessary times to lift up the first and the second bin drive bars 17*a*, 7*b*, which brings the uppermost bin tray in the lower stack 1D into the lowermost position in the upper stack 1U. By this lift-up operation of the bin trays 1 by the lifting device, the enlarged spacing GB is formed between the before-uppermost bin tray in the lower stack 1D and the next lower bin tray. Also the spacing will be the narrow spacing GB between the before-uppermost bin tray in the lower stack 1D and the before-lowermost bin tray in the upper stack 1U. If the transfer sheet is curved or if a substantial number of transfer sheets have been loaded on the bin tray 1, the before-lowermost bin tray in the upper stack 1U would press the transfer sheets p on the next bin tray to correct the curvature or to reduce the thickness of the loaded sheets.

As described, the sorting operation will be completed by the intermittent lifting operations of the bin trays 1 by the lifting device 40 and the receiving operation of the transfer sheets p from the image forming apparatus onto the bin tray 1. After the completion of the sorting, if the sorting and the storing apparatus receives a command to perform stapling operation of the sheets from the image forming apparatus, the sorting and storing apparatus will proceed with the stapling operation by the stapler.

In this embodiment, the suspension wire is employed for the lifting device of the bin trays 1, but other lifting devices may be employed. Also, the rollers 31 are not essential. A pair of recesses and protrusions will do for the purpose between the upper and the lower surfaces of the cam tracks 10. Further, the rollers 31 are balls in this embodiment, but they may be replaced by cylinders. Furthermore, the jogger wire for the transfer sheet jogging on the bin tray 1 may be substituted by a jogger bar of rod.

Figure 3:
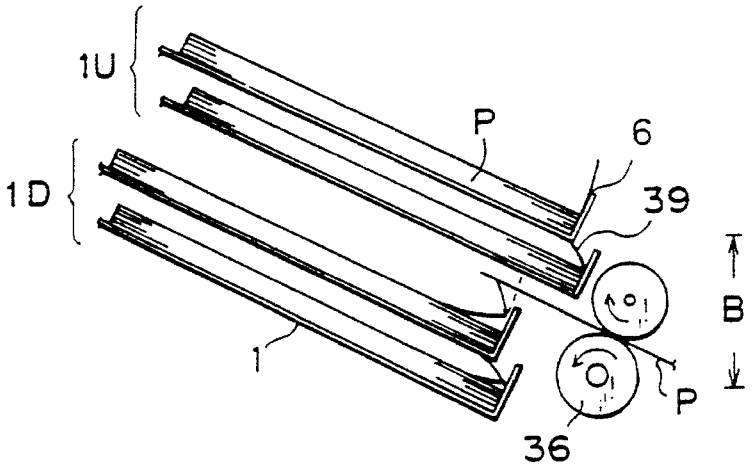
FIG. 3 is a sectional view of a part of the sheet sorting and storing apparatus of FIG. 1 according to the present invention showing the deviation part enlarged.

Next described is the sheet sorting and storing apparatus according to the present invention with reference to FIG. 3. Since the arrangement and the operation of the first embodiment as shown in FIGS. 1 and 2 are also employed in FIG. 3, the description in FIGS. 1 and 2 is incorporated here and detailed explanation is omitted to avoid redundancy.

In FIG. 3, reference numeral 39 denotes a sheet press piece vertically mounted at the sheet entrance edge of bin tray 1. The sheet press piece 39 is of plastic film having flexibility. If the transfer sheet p discharged onto the bin tray 1 is bent or curved, the sheet press piece 39 will correct the curve to keep the transfer sheet planar on the tray. In detail, if the transfer sheet is bent, the free end of the sheet press piece 39 contacts with the back of the bin tray 1 located at the lowermost position in the upper stack 1U to bend to lie over the loaded transfer sheets. The free end of the press piece 39 corrects the bending of the transfer sheet by pressing down the bent sheet. Also, after a substantial number of sheets have been stored on the tray, the entire face of the transfer sheet will be urged against the back of the next-above bin tray 1 to correct the curve.

Since the sheet press piece 39 is mounted at the sheet entrance side, even a bent sheet may be prevented from leaping out of the trays 1 and stored in a flat condition, improving the efficiency of sheet storage.

Next described is the second embodiment of the sheet sorting and storing apparatus in FIG. 4 to 8 according to the present invention.

The second embodiment is essentially the same as the first embodiment. Components illustrated in FIG. 4 to 8 which are identical to components illustrated in FIG. 1 to 3 are identified by the same reference numbers, and therefore, an explanation of the identical components will not be repeated.

In FIG. 5 to 8, numeral 2 denotes a movable fence which is mounted at the end fence of the bin tray. The movable fence is forced upwardly by a torsion spring 13 which is mounted beyond the maximum width of transfer sheets discharged onto the bin tray 1. Therefore, the movable fence 2 stands upright by the spring 13 when the spacing between the bin trays is opened relatively, and the fence 2 lies down by pressure of the upper bin tray when the spacing between the bin trays is kept narrow.

Numeral 3 denotes a flexible film which is mounted to the movable fence 2. The end of the flexible film 3 touches a bottom of the upper bin tray.

The detailed structure of the second embodiment of tie bin tray will be explained below with reference to FIG. 6 to 8.

The movable fence 2 is a long-pillar and has a triangle sectional view. The fence 2 is mounted on an upper end face of the end fence 6 of the each bin trays. And the movable fence 2 is connected to the end fence 6 through the flexible film 3 which has a long rectangle shape sheet. The lower part of the flexible film 3 is adhered to the end fence 6 and the middle part of the film 3 is adhered to the movable fence 2. And the top part of the film is a free part which is projected from over the movable fence.

Therefore, a connection part C of the movable fence 2 works as an axis. The movable fence 2 stands up when the spacing between the bin trays is opened, and the fence 2 lies down when the spacing is kept narrow. Numeral 13 denotes a torsion spring whose one end is adhered onto the bin 1 and whose other end is adhered to the movable fence 2.

Figure 6:
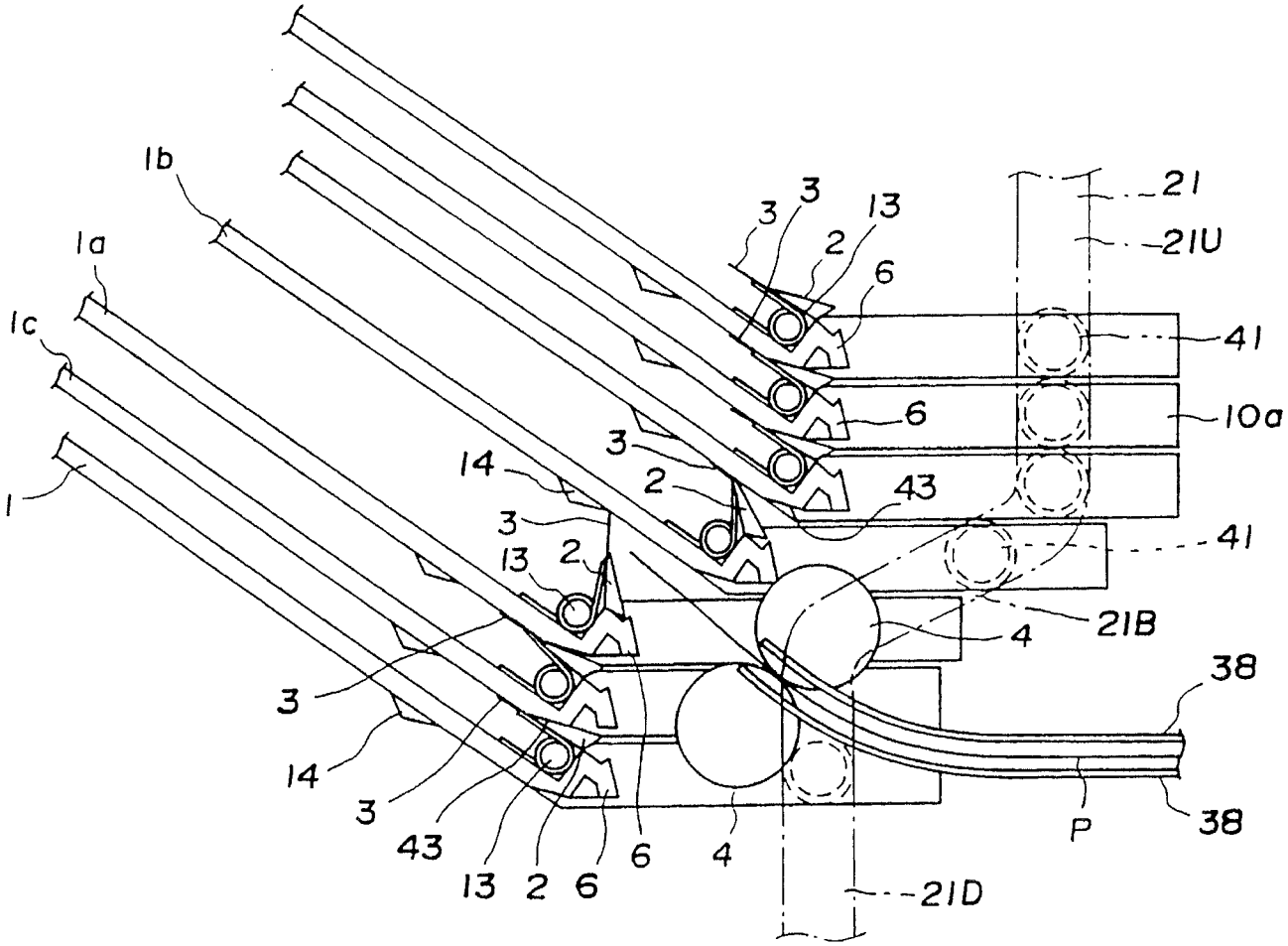
FIG. 6 is an enlarged drawing of bin trays illustrating the deviation of bin trays in the apparatus of FIG. 4.
Figure 7:
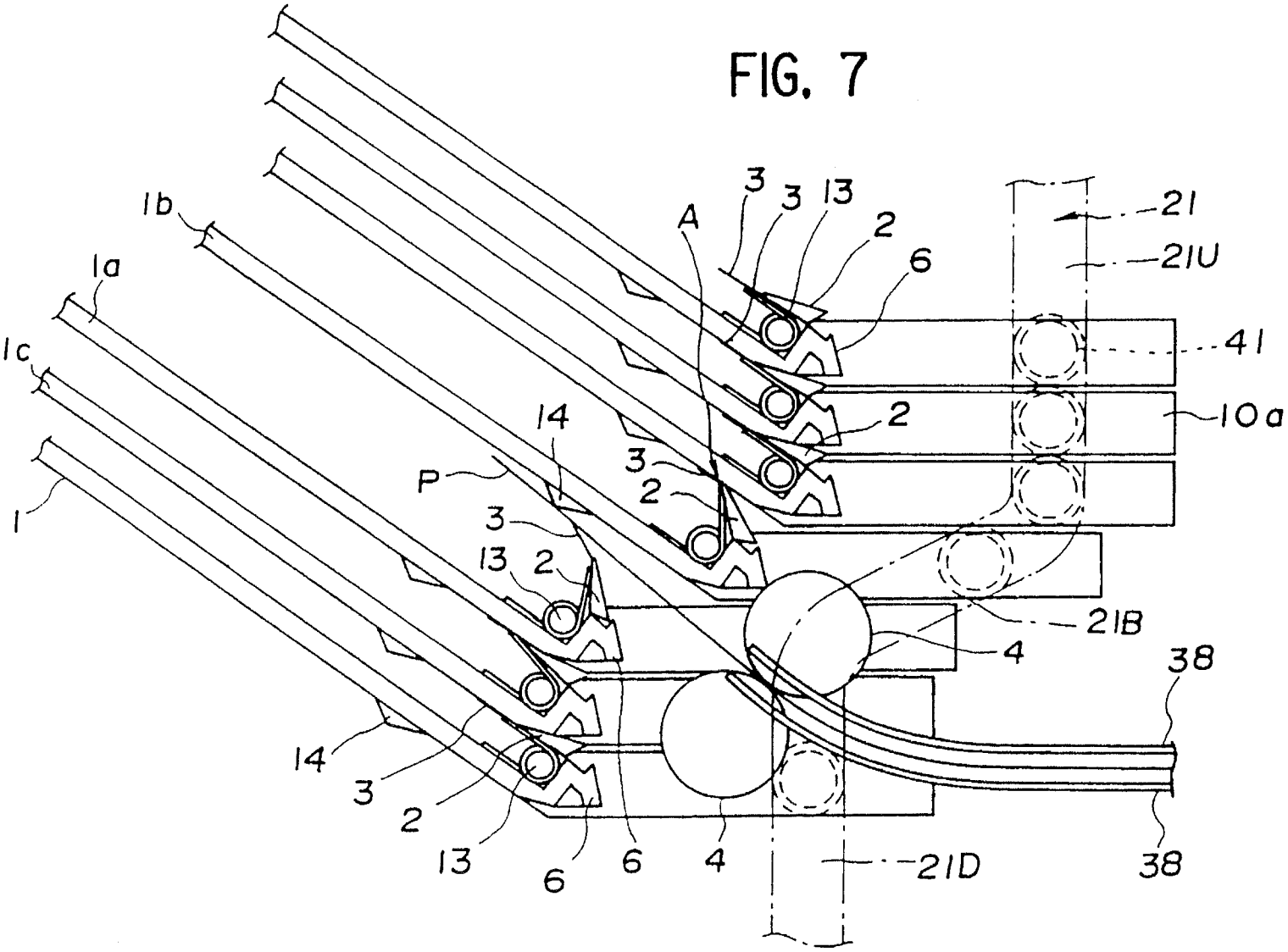
FIG. 7 is an enlarged drawing of bin trays illustrating the deviation of bin trays in the apparatus of FIG. 4.
Figure 8:
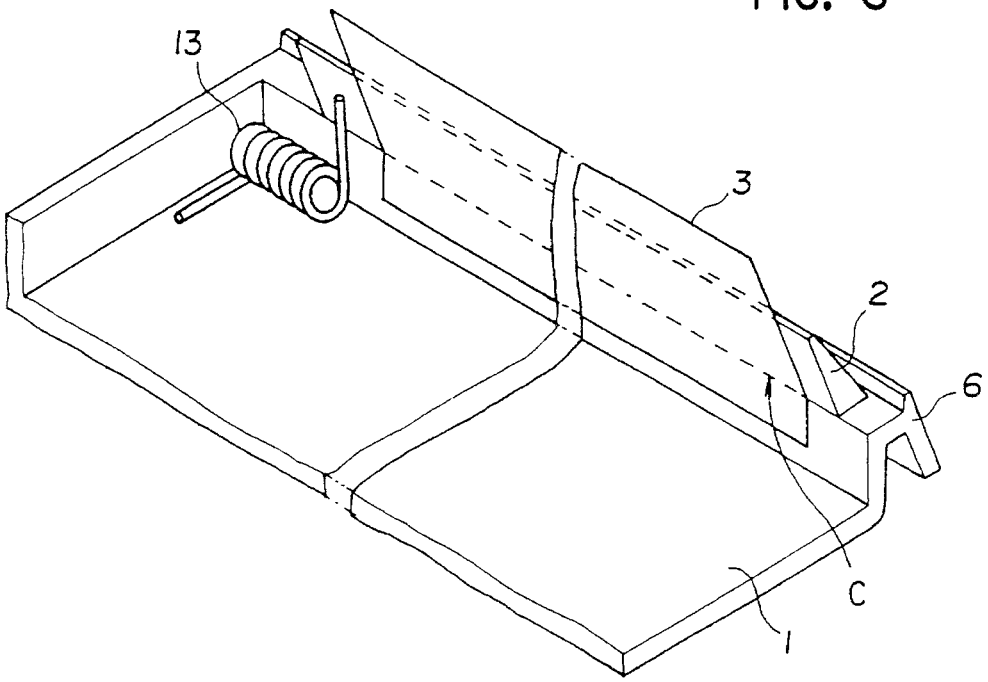
FIG. 8 is a fragmentary perspective view of the bin tray in the apparatus of FIG. 4.

When the bin tray **1*a* as shown in FIG. 6 and 7 reaches the deviation part, the spacing between the bin tray 1*a* and the bin tray 1*b* is opened, and the movable fence 2 of the bin 1*a* has stood up and the free portion of the flexible film 3 in the bin 1*a* is touching the bottom of the upper bin 1*b*. On the other hand, when the bin tray, like a bin 1*b* or 1*c*, is not in the deviation part, the spacing between the bin trays is kept narrow and the upper bin pushes the movable fence 2 and the movable fence 2** lies down.

Numeral 14 denotes a guide projection whose sectional view is triangle. And the projection 14 are mounted to a bottom of each bin 1 to guide the sheet which is transferred onto the bin tray. Numeral 43 denotes a recess into which the movable fence 2 is put when the space between the bins is narrow. And the recess 43 is formed on a bottom of each bin 1.

And below described is an operation of the apparatus of the second embodiment. And also an explanation of the identical operation will not be repeated.

As described above, the paired sheet discharge rollers 4 are mounted to face the sheet receiving ends of the bin trays 1 in the deviation region B, and the transfer sheet p is discharged through the enlarged spacing of the bin trays 1. The transfer sheet p pushes the free end of the flexible film 3, and then the free end of flexible film 3 moves from the position of FIG. 6 to the position of FIG. 7. The sheet discharged from the rollers 4 leans against the rear end aligning fence 6 because of its own weight, aligning its rear end. After the sheet has passed the free end of the film, the film 3 stands up again as shown in FIG. 6 by elasticity of the film 3 itself. Therefore, the sheet cannot be transferred back over the flexible film 3.

The detail operation of the second embodiment of the bin tray will be explained below.

At first, suppose the bin tray is in the lower stack 1D. When the space between the bin trays is narrow, the movable fence 2 pushes the bottom of the upper tray, and the free end of the flexible film 3 does not bend. And, there is no pressure to the free end of the film 3 so that the flexible film 3 will not have lost its characteristic of flexibility for a long time.

Secondly, suppose the bin tray is in the position of a deviation region **1*a*. As the space between the bin trays becomes opened, the movable fence 3 and flexible film 3 are raised up by the force of the spring 13. Even if the connecting part of the flexible film 3 between the end fence and the movable fence 2 has lost its flexibility, the movable fence 2 can still stand quickly by the force of the spring 13 to prevent the sheet from transferring back to the sheet discharge roller 4. And when the sheet is already bent downward before touching the movable fence 2 the free end of the sheet touches the movable fence 2 and is guided along the movable fence 2 to the flexible film 3**.

Thirdly, suppose the bin tray 1*a* moves from the position of a deviation region to the upper position, and the tray stays in the upper stack 1U. As the space between the bins becomes narrower, 1) at first the flexible film 3 is being folded by the pressure the upper bin tray, 2) then the bottom of the upper bin tray touches the movable fence 2 and pushes it, and 3) the movable fence 2 lies down and moves into the recess 43.

Figure 4:
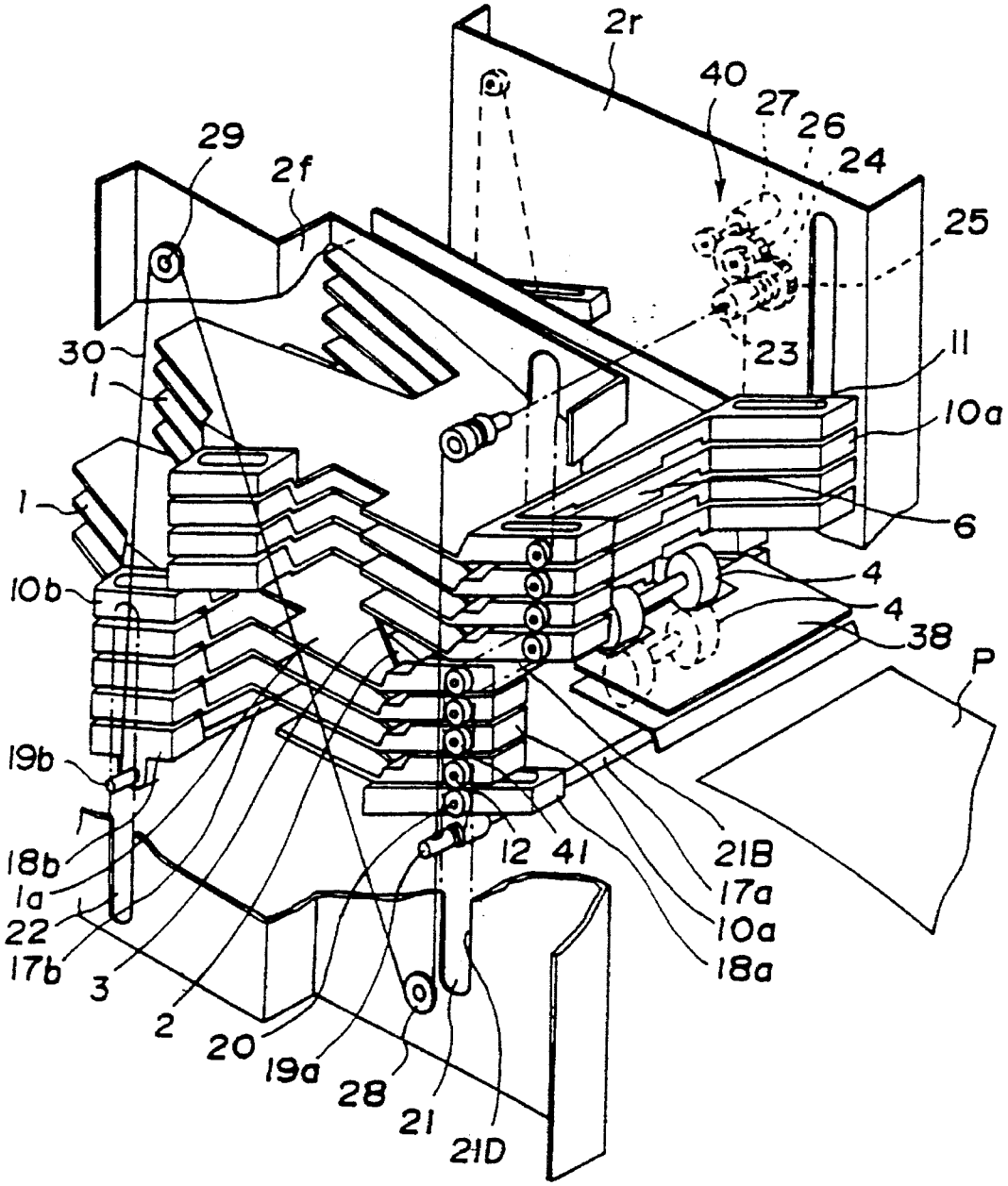
FIG. 4 is a perspective view of the second embodiment of the sheet sorting and storing apparatus according to the present invention.
Figure 5:
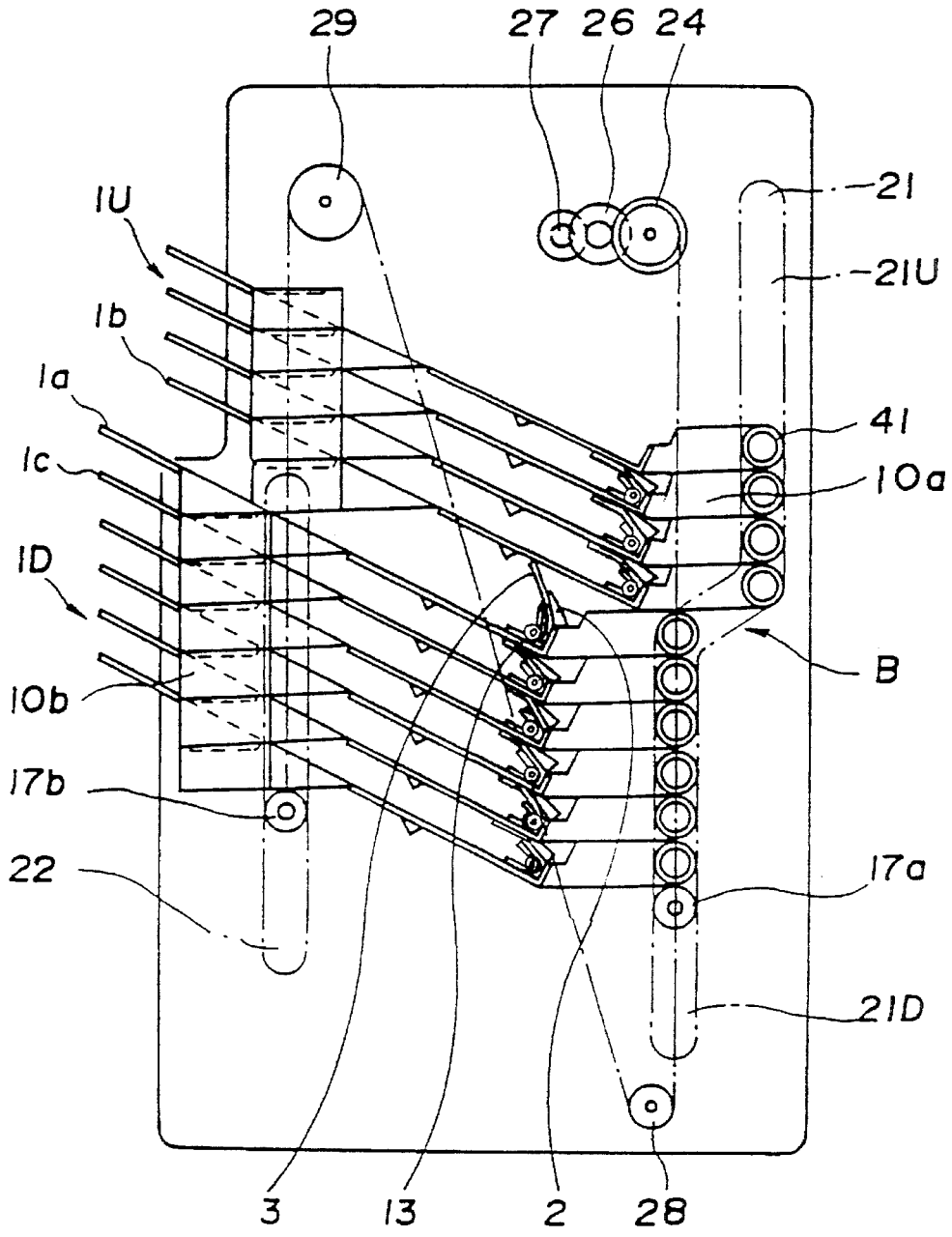
FIG. 5 is a drawing illustrating deviation of bin trays in the sheet sorting and storing apparatus of FIG. 4.

When the bin tray 1*a* is in a deviation region as shown in FIG. 3 and 4, the movable fence 3 at the end fence of the bin 1*a* has stood up by the elasticity of the torsion spring 13, and the free end portion of the flexible film touches the bottom of the upper bin 16. The end fence of the bin tray 1*a*, the movable fence 2 and the flexible fence 3 form a high end fence as a whole, and they keep the transfer sheet p in the bin tray 1*a* from transferring back to the sheet discharge roller. The free end of the transfer sheet p which is being transferred onto the bin tray 1*a* at first touches the flexible film 3 and pitches it forward. And then the film 3 bends, the sheet p is guided by the guide projection 14 and enters onto the bin tray.

According to the second embodiment of the present invention, many sheets can be stacked in the bins. This lack of an axis to move the movable fence may lower the cost of production.

Figure 9:
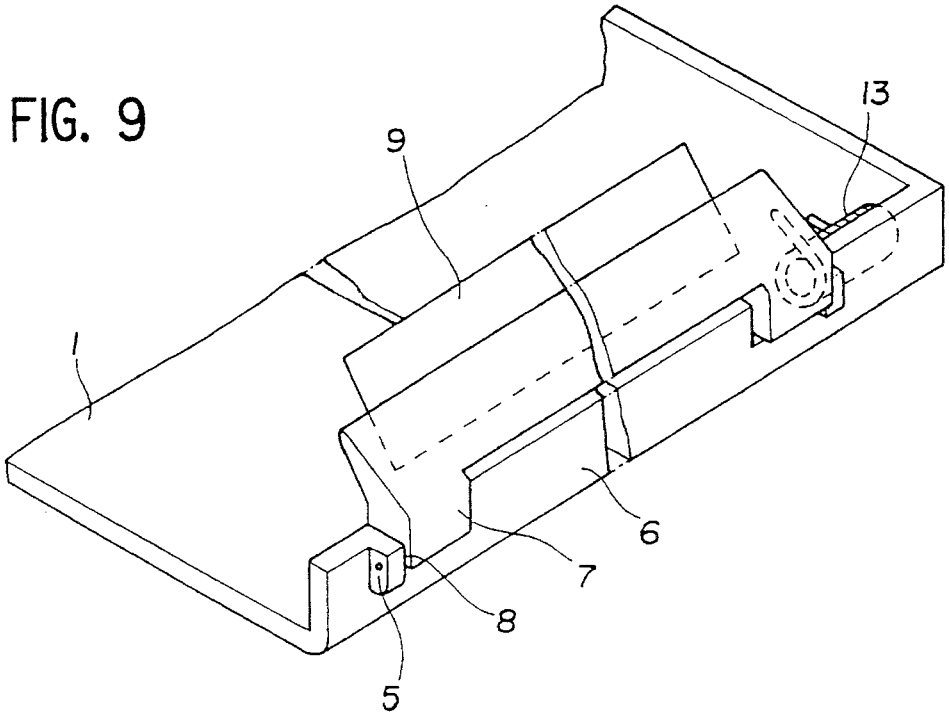
FIG. 9 is a fragmentary perspective view of a third embodiment of the bin tray according to the present invention.
Figure 10:
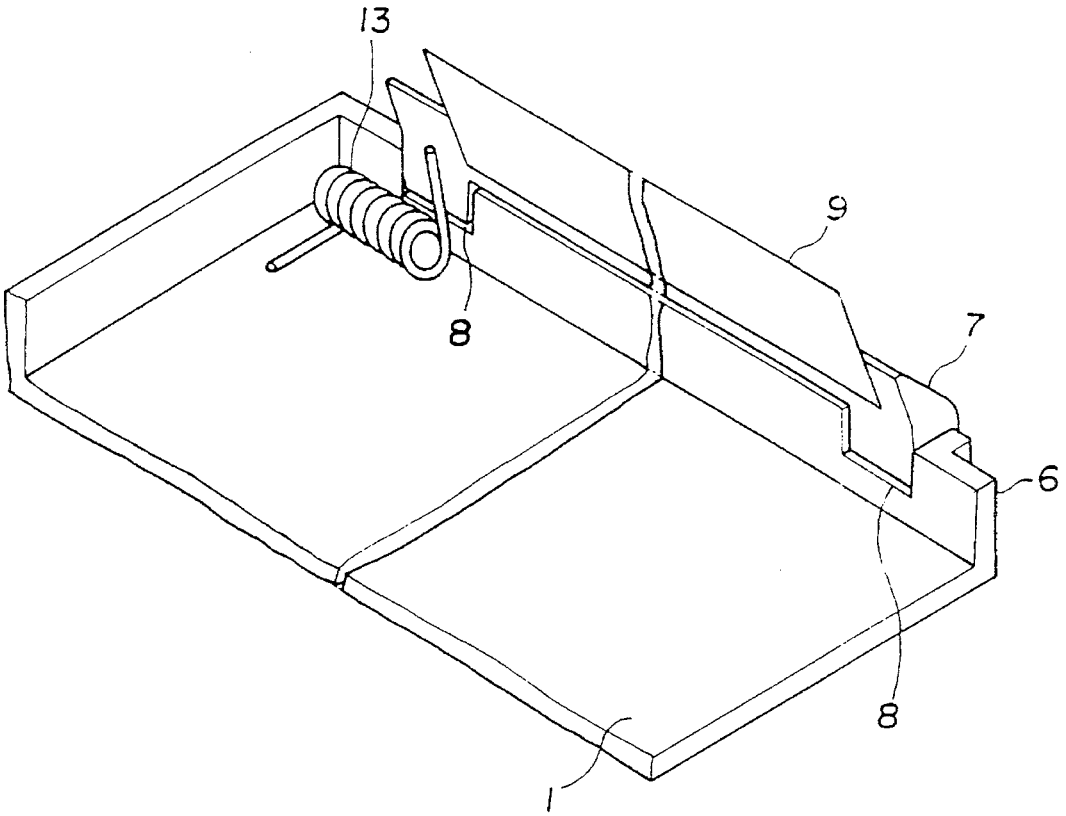
FIG. 10 is an another fragmentary perspective view of the bin tray of FIG. 9.

Next, described is the third embodiment of the sheet sorting and storing apparatus in FIG. 9 and 10 according to the present invention.

The third embodiment is essentially the same as the second embodiment. However, it is different from the second embodiment in that the end fence 6 has two grooves 8, that the movable fence 7 has two blocks 7*a* and 7*b* which extend into the grooves 8, and that the blocks 7*a* and 7*b* are rotatively supported by pins 5. A flexible film 9 is adhered to the movable fence 7 and the top part of the film 9 is a free part projected from the movable fence 7. Consequently, the movable fence 7 and the flexible film 9 are rotatable on the pin 5 as a pivot.

Figure 11A:
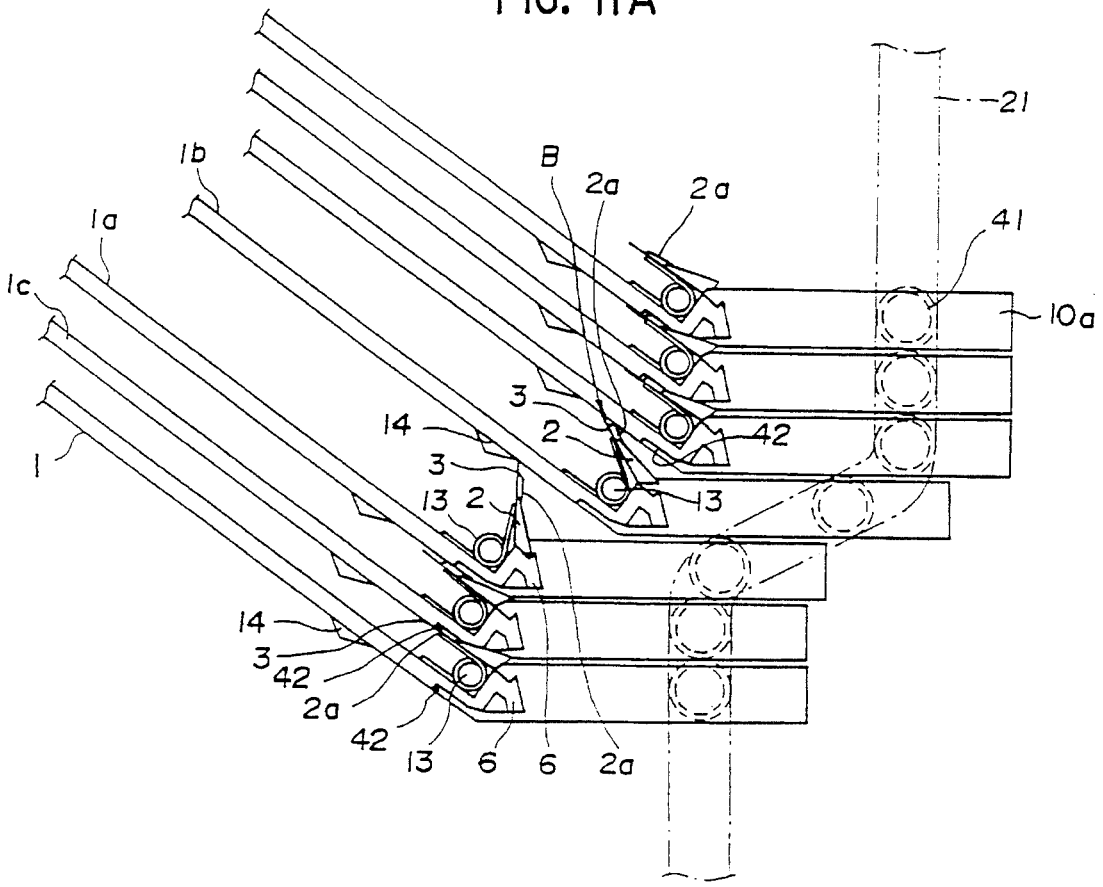
FIG. 11 (*a*) is a drawing of a fourth embodiment of the bin tray in the sheet sorting and storing apparatus.
Figure 11B:
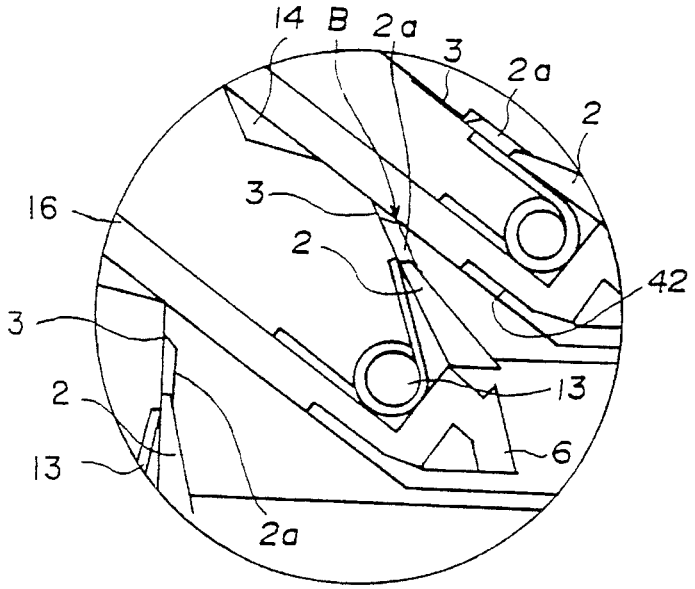
Figure 12:
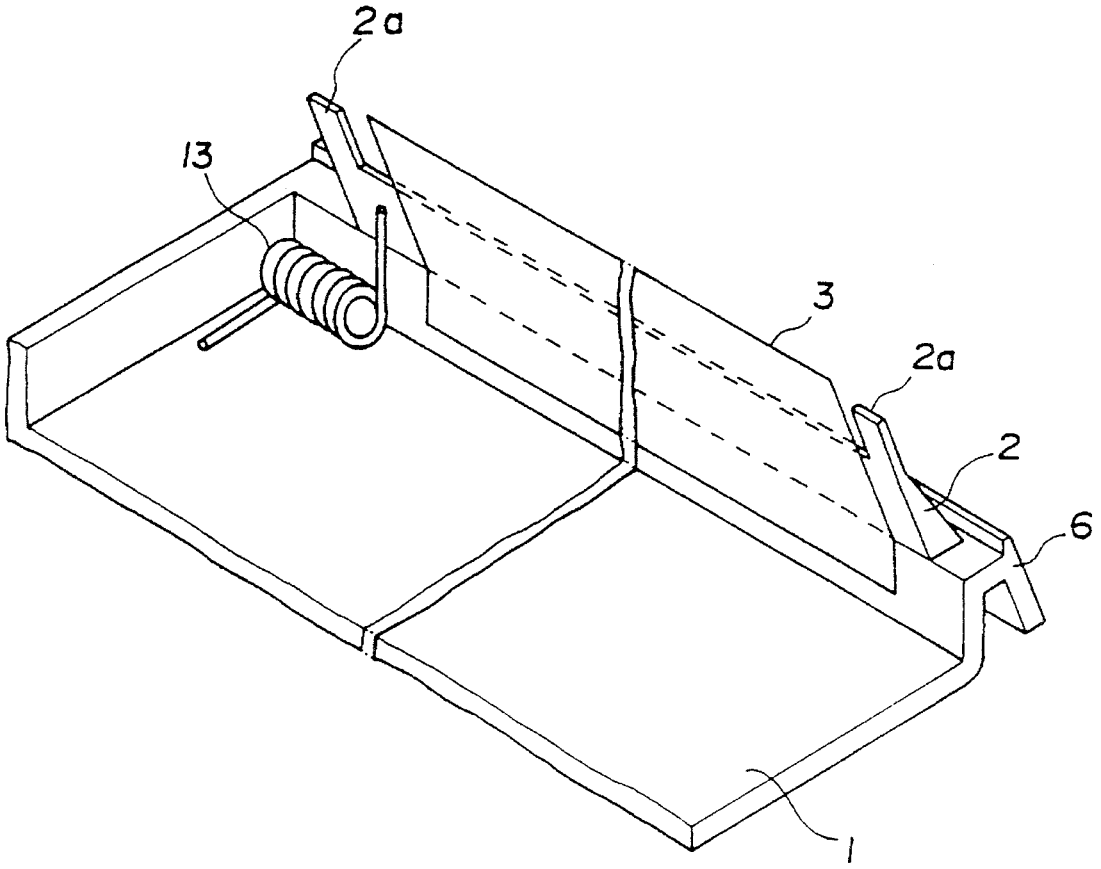
FIG. 12 is a fragmentary perspective view of the bin tray of FIG. 11(*a*).

Next, described is the fourth embodiment of the sheet sorting and storing apparatus in FIG. 11(*a*), 11(*b*) and 12 according to the present invention.

And the fourth embodiment is essentially the same as the second embodiment. However, it is different from the second embodiment in that two tongues 2*a* and 2*b* are formed on the top portion of the movable fence 2. The distance between the two tongues is longer than the maximum length of the sheet width. And the flexible film 3 is taller than the tongues 2*a*. Numeral 42 denotes a recess in which the tongues 2*a* and 2*b* are stored when the spacing between the bins is kept narrow.

In the above second embodiment, when the space becomes narrow as shown in FIG. 7, the flexible film 3 is pressed by the upper bin, and the film 3 may be damaged as shown at A in FIG. 7. But in the fourth embodiment, when the spacing between the trays first starts to narrow, the tongues 2*a* and 2*b* touch the bottom of the upper bin tray as shown in FIG. 11(*a*) and 11(*b*) to keep the film from being damaged.

It will be obvious to those skilled in the art that the sheet sorting and storing apparatus of this invention is not limited to use is the sheet sorting and storing apparatus which has been moved in a horizontal direction. But this invention may be used in the other type of the sheet sorting and storing apparatus.

What is claimed as new and is desired to be secured by Letters Patent of the United States is:

1. A sheet sorting and storing apparatus comprising:

a plurality of vertically stacked bin trays each having an introducing side positionable with respect to an external sheet feeding device, and a loading face inclined in a discharge direction of a sheet discharged out of the external device so as to receive the discharged sheet therefrom;

supporting means for supporting each of said bin trays for movement in a substantially horizontal direction;

deviating means for moving at least one of said stacked bin trays in said substantially horizontal direction such that an upper space above a desired one of said bin trays which is to receive a discharged sheet is enlarged, said upper space being defined as a distance between said loading face of said desired one of said bin trays and a bottom face of an upwardly adjacent bin tray above said desired one of said bin trays in a direction perpendicular to said inclined direction; and sheet press means extending upwardly on said introducing side of each of said bin trays for pressing a sheet being received in said bin tray, each of said sheet press means having a tip end and comprising means such that the tip end of said sheet press means stands upright when said upper space is enlarged and engages the bottom face of said upwardly adjacent bin tray so as to lie towards said loading face when said upper space is not enlarged.

2. A sheet sorting and storing apparatus according to claim 1, wherein said sheet press means comprises a flexible film of elastic material.

3. A sheet sorting and storing apparatus according to claim 1, wherein each said bin tray has an end fence at said sheet introducing side thereof, and wherein said sheet press means further comprises:

a movable fence pivotally connected to said end fence and extending vertically therefrom;

a flexible film extending from said movable fence; and driving means for forcing the movable fence to stand uprightly.

4. A sheet sorting and storing apparatus according to claim 3, wherein said driving means is a spring.

5. A sheet sorting and storing apparatus according to claim 3, wherein said movable fence is pivotally connected to the end fence of the bin tray via the flexible film.

6. A sheet sorting and storing apparatus according to claim 3, wherein each said bin tray has a recess formed on the bottom of said bin tray where the movable fence is stored when said upper space is not enlarged.

7. A sheet sorting and storing apparatus according to claim 3, wherein the movable fence has tongues on a top portion thereof, and wherein a distance separating said tongues is longer than a maximum discharged sheet width.

8. A sheet sorting and storing apparatus according to claim 3, wherein each said bin tray has a projection formed on the bottom of said bin tray.

9. A sheet sorting and storing apparatus comprising:

a plurality of vertically stacked bin trays each having an introducing side positionable with respect to an external sheet feeding device, and a loading face inclined in a discharge direction of a sheet discharged out of the external device so as to receive the discharged sheet therefrom;

a movable fence pivotally connected to each of said bin trays at said introducing side and extending vertically therefrom;

a flexible film extending from said movable fence; and driving means for forcing the movable fence to stand uprightly.

10. A sheet sorting and storing apparatus according to claim 9, wherein said driving means is a spring.

11. A sheet sorting and storing apparatus according to claim 9, wherein each said movable fence is pivotally connected to the bin tray via the flexible film.

12. A sheet sorting and storing apparatus according to claim 9, including supporting means for supporting each of said bin trays for movement in a substantially horizontal direction, and deviating means for moving at least one of said stacked bin trays in said substantially horizontal direction such that an upper space above a desired one of said bin trays which is to receive a discharged sheet is enlarged, said upper space being defined as a distance between said loading face of said desired one of said bin trays and a bottom face of an upwardly adjacent bin tray above said desired one of said bin trays in a direction perpendicular to said inclined direction, wherein each said bin tray has a recess formed on the bottom of said bin tray where the movable fence is stored when said upper space is not enlarged.

13. A sheet sorting and storing apparatus according to claim 9, wherein the movable fence has tongues on a top portion thereof, wherein distance separating said tongues is longer than a maximum discharged sheet width.

14. A sheet sorting and storing apparatus according to claim 9, wherein each said bin tray has a projection formed on the bottom of said bin tray.

* * * * *